US005509261A

United States Patent [19]

Wassenhoven et al.

[11] Patent Number: 5,509,261

[45] Date of Patent: Apr. 23, 1996

[54] STEPPING MOTOR ARRANGEMENT FOR DRIVING A SILVER FEED ROLLER IN A ROTOR SPINNING MACHINE

[75] Inventors: Heinz-Georg Wassenhoven, Moenchengladbach; Manfred Lassmann, Nettetal, both of Germany

[73] Assignee: W. Schlafhorst AG & Co., Moenchengladbach, Germany

[21] Appl. No.: 215,277

[22] Filed: Mar. 21, 1994

[30] Foreign Application Priority Data

Mar. 26, 1993 [DE] Germany ..... 43 09 948.3
Feb. 12, 1994 [DE] Germany ..... 44 04 503.4

[51] Int. Cl.[6] ..... D01H 13/26; D01H 7/46

[52] U.S. Cl. ..... 57/263; 57/92; 57/93; 57/100; 57/264; 57/408; 57/412

[58] Field of Search ..... 57/263, 264, 406, 57/408, 412, 92, 93, 97, 100; 19/200, 159 R

[56] References Cited

U.S. PATENT DOCUMENTS

| | | | |
|---|---|---|---|
| 4,125,991 | 11/1978 | Stahlecker | 57/302 |
| 4,327,546 | 5/1982 | Derichs et al. | 57/263 |
| 4,672,802 | 6/1987 | Raasch | 57/263 |
| 4,897,993 | 2/1990 | Raasch et al. | 57/302 |

FOREIGN PATENT DOCUMENTS

| | | |
|---|---|---|
| 0385530A1 | 2/1990 | European Pat. Off. . |
| 2629161 | 6/1976 | Germany . |
| 2850729A1 | 6/1980 | Germany . |
| 2518224C2 | 1/1986 | Germany . |
| 3425345A1 | 1/1986 | Germany . |
| 3427356A1 | 2/1986 | Germany . |
| 3715934A1 | 11/1988 | Germany . |

OTHER PUBLICATIONS

"Elektronische OE–Effektgarneinrichtung", *Chemiefasem/Textilindustrie,* 41/93, Jahrgang, Apr. 1991, p. 347.

"Elektronisches Garnueberwachungssystem Corolab fuer Rotor–Spinn–spulautomaten Autocoro", *Chemiefasern/Textilindustrie,* 40/92, Jahrang, Apr. 1990, pp. 356 and 358.

*Primary Examiner*—William Stryjewski
*Attorney, Agent, or Firm*—Shefte, Pinckney & Sawyer

[57] ABSTRACT

A rotor spinning machine has a plurality of simultaneously operated spinning stations each with a spinning rotor, an opening roller, a feed roller for delivering sliver to the opening roller, and a stepping motor connect directly to the feed roller for driving thereof. An actuating arrangement is provided for selectively actuating each stepping motor in a normal increment mode during spinning operation and in a microincrement mode during yarn piecing operations.

6 Claims, 3 Drawing Sheets

STEPPING MOTOR ARRANGEMENT FOR DRIVING A SILVER FEED ROLLER IN A ROTOR SPINNING MACHINE

BACKGROUND OF THE INVENTION

The present invention relates to a rotor spinning machine having a plurality of simultaneously operated spinning stations with respective driven spinning rotors, opening rollers, and feed rollers for delivering sliver to the opening rollers.

Generally, in rotor spinning machines, sliver is fed into the opening fixtures at the multiple spinning stations via feed rollers, each of which is connected via worm gear to a common drive shaft extending along the entire spinning machine. In the event of a yarn or sliver break, and during piecing operations, the feed roller is disconnected from the drive shaft via a shiftable coupling. Disadvantageously, connection of the feed rollers to a common drive shaft for driving the feed rollers of the entire machine does not allow individual feeding of the sliver at a spinning station.

For that reason, individual drives of the feed rollers have already been proposed, as known for instance from German patent disclosure DE-OS 34 25 345. However, variable-rpm DC or AC motors as suggested in such reference require expensive control technology in order to establish an individualized speed for a given spinning station rpm.

SUMMARY OF THE INVENTION

It is accordingly an object of the present invention to provide an individual drive for the spinning stations of a rotor spinning machine that is simple in design.

To attain this object according to the present invention, stepping motors are provided for driving the feed rollers of rotor spinning stations. The drive shafts of the stepping motors may be joined directly to the drive shafts of the feed rollers, which advantageously dispenses with the use of shiftable couplings or speed-change gears. Gears are subject to wear, which creates looseness in the coupling or slippage and leads to inaccurate sliver feeding. In turn, an especially adverse affect may be produced in yarn piecing operations if uneven quantities of sliver are fed into the spinning station. Connecting the stepping motors to a control unit from which the operation of each spinning station can be controlled individually enables feeding of the sliver to be adjusted individually to the particular circumstances at the spinning station.

An especially advantageous possibility for using stepping motors arises in piecing operations. In piecing, a very specific yarn quantity must be fed into the rotor so that piecing of the yarn will conform to the yarn thickness. The quantity of sliver fed must be such that no fluctuations in yarn thickness will occur. In piecing, the rotational speed (rpm) of the feed roller can be adjusted individually to the yarn parameters, in particular the type of fiber, the fiber length, and the yarn count. A mechanical drive connection with the piecing carriage, which is conventionally required, becomes unnecessary and eliminates the need for coupling devices, which necessarily have tolerances.

In a rotor spinning machine, piecing of a yarn as a rule takes place at a lower rotor speed (rpm) than the normal operating speed (rpm). Thus, in the present invention, feeding of the sliver can be controlled accordingly via the stepping motor as the spinning station accelerates up to its operating speed.

According to the present invention, the stepping motor should be drivable during piecing operations in a microincrement mode, i.e., in such rapidly repetitive increments of actuating the poles of the stepping motor to advance in minute angular increments of rotation, with such brief intervening increments, that the motor essentially operates continuously in the nature of a DC motor. Thus, the microincrement mode enables very accurate adaptation of the driven speed of the rotor to the given spinning operation. This is especially important in the yarn piecing phase, where feeding of the fibers into the rotor must be conformed very accurately to the rotor rpm and to the draw-off speed of the yarn.

The possibility of triggering the stepping motor in the microincrement mode may be accomplished at each spinning station and may be actuated, for instance, by a microprocessor in a spinning station control unit, whenever a piecing operation is initiated. The advantages of the microincrement mode can then be utilized. Once the piecing operation is completed, the actuating unit can be changed to a normal increment mode via the microprocessor, so that the stepping motor thereafter feeds the sliver at the intended delivery speed in normal spinning operation. The actuating unit of the stepping motor at the spinning station may be designed both for operation in the normal increment mode and for operation in the microincrement mode.

If the spinning machine utilizes a service carriage, which during piecing controls the spinning apparatus at the spinning station by means of a control unit when the yarn is being repieced, the actuating unit for the microincrement mode of the stepping motor may be installed in the service carriage and controlled by the control unit. Thus, once the service carriage is positioned at a spinning station, the control unit of the service carriage takes over the control of the stepping motor. When the control unit of the service carriage enters into operative connection with the stepping motor via the actuating unit for the microincrement mode, the actuating unit can intervene into the control unit of the spinning station, so that this unit cannot affect the performance of the stepping motor during the piecing operation. Installation of the actuating unit for the microincrement mode, which is used solely for piecing, on the service carriage is more cost-effective than if each spinning station were equipped with a control unit designed for both modes. The prerequisite however is that a piecing carriage be present.

It is also contemplated that the service carriage can accomplish an electrical separation of the stepping motor from its spinning control unit and from the spinning station power supply and at the same time establish an electrical contact between the control unit of the service carriage and the stepping motor at the spinning station, so that the power supply and control to the stepping motor in the piecing phase are accomplished solely by means of the control unit of the service carriage.

According to an advantageous feature of the invention, a sensor spaced in advance of the feed roller may be provided for monitoring the incoming sliver and may be operatively connected to the control unit. If the sliver supply runs out or if the sliver breaks, this sensor can ascertain the absence of sliver and signal the control unit to advantageously stop the drive of the feed roller directly, so that new sliver can be spliced to the sliver residue still remaining that has not yet been drawn into the spinning box. This makes sliver delivery easier, because the sliver need no longer be introduced between the feed roller and the sliver feed table.

A further feature of the invention provides a sensor for monitoring the yarn quality which is connected to the control unit. If this sensor detects a significant yarn defect or flaw, then the yarn is cut and the control unit stops the motor of the feed roller and hence the feeding of sliver.

Stepping motors also have several additional advantages with regard to control technology. By means of digital triggering, for instance by a random generator, any arbitrary rotor speed (rpm) within a given unit of time can be established, which can be advantageously exploited to produce special-effect yarns, for instance. By the clocked specification of a predetermined rotor speed per unit of time, yarn effects that are distributed unevenly over the yarn length can be accomplished, which offers special advantages compared with effects distributed evenly over the yarn length, e.g., the weaving of such a yarn can produce moir é effects. Another advantage attained by use of stepping motors is that sliver flaws that are detected by the yarn quality sensor can be eliminated. Fluctuations in thickness of the drawn-in sliver, flaws that occur if the sliver shifts, and long-term flaws in sliver can be eliminated by adjusting the sliver feeding speed of the feed roller to the flaws, which makes it possible to compensate for fluctuations in thickness of the sliver.

DESCRIPTION OF THE PREFERRED EMBODIMENT

Figure 1:
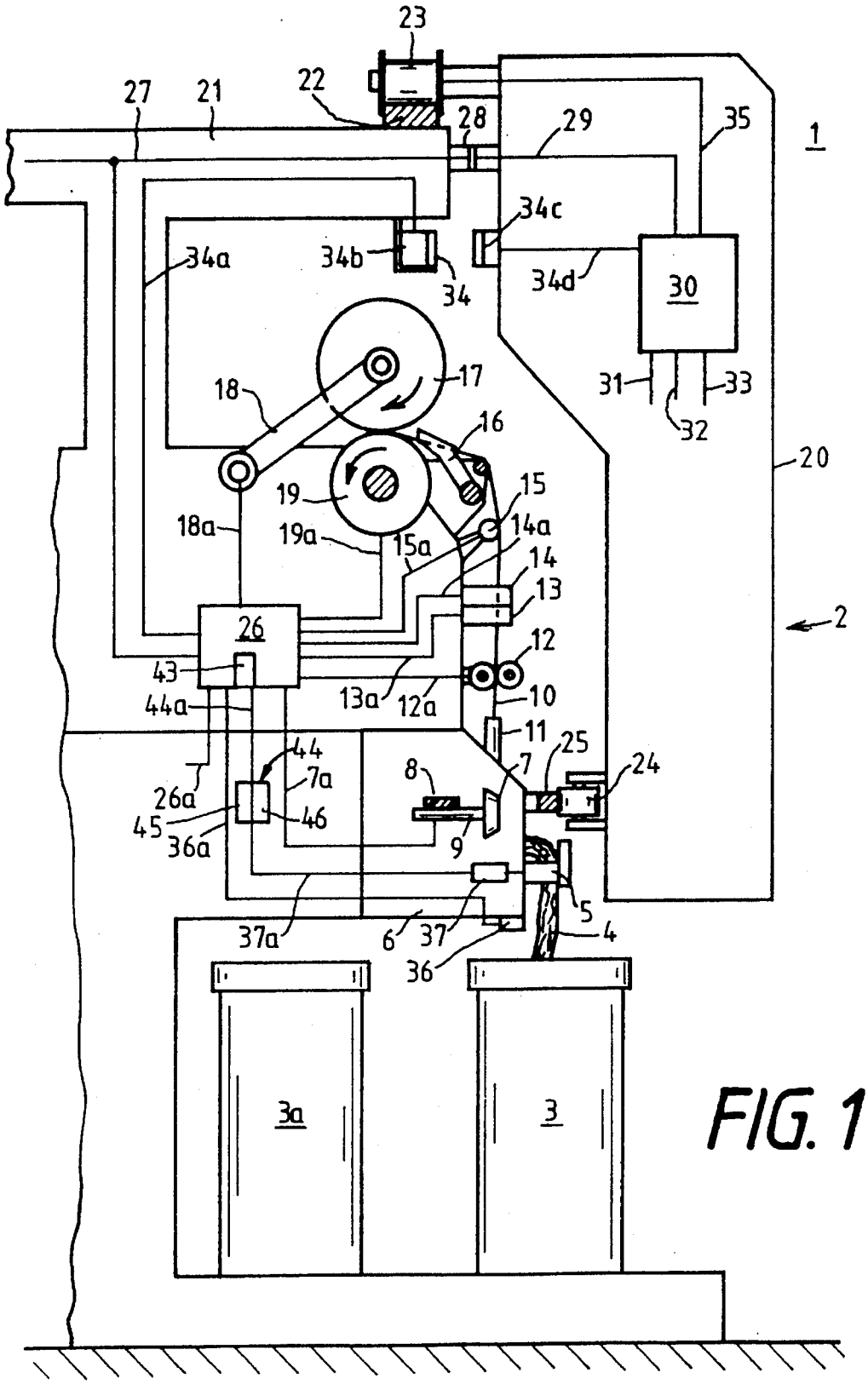
FIG. 1 is a schematic end view of one spinning station of a rotor spinning machine, the spinning station having a stepping motor driving the sliver feed roller and an actuating unit for controlling operation of the stepping motor in both the normal increment mode and the microincrement mode.

FIG. 1 depicts a representative rotor spinning machine 1, which includes a plurality of individual spinning stations aligned side by side along the length of the machine, only one of which is shown here in end view. Since the basic construction and operation of rotor spinning machines are well-known, only the characteristics contributing to comprehension of the present invention are schematically illustrated and will be explained.

At the spinning station 2, sliver 4 is drawn into a socalled spinning box 6 from a sliver can 3 through a sliver condenser 5. An additional sliver can 3*a* rests adjacent the can 3 as a reserve supply of sliver, or alternatively may furnish sliver to an adjacent spinning station (not shown). The operational components arranged in the spinning box 6 for drawing in the sliver, opening the sliver into individualized fibers, and feeding them into the rotor 7, are known in the art and therefore not shown or described in detail. The drive of the rotor 7 comprises a driven belt 8 traveling in peripheral engagement with the rotor shaft 9. The belt 8 extends along the length of the machine and drives all the rotors of the spinning stations along one longitudinal side of the spinning machine. Individual drives for each rotor are also possible, however.

In the rotor 7, the yarn 10 is formed and is drawn from the rotor 7 through a yarn doff tube 11 by a pair of draw-off rollers 12. The yarn then travels past a sensor 13, commonly referred to as a cleaner, for monitoring the yarn quality. The cleaner 13 is followed by a cutting device 14, which is operative to sever the yarn if a yarn defect is detected. A tension sensor 15 may also be provided by which the yarn tension can be monitored. The yarn is then wound in cross-wound layers onto a bobbin or cheese 17 with the aid of a yarn guide 16. The cheese 17 is carried by a creel arm 18 that is pivotably supported on the spinning machine frame, the cheese 17 resting peripherally on and being driven by a winding drum 19 so that the yarn is wound in cross-wound layers. The directions of rotation of the bobbin and the bobbin drum are represented by arrows.

Each spinning station 2 has a control unit 26 which is connected to the various controllable devices and functional components of the spinning station 2 over signal lines and by which the operational sequences at the respective spinning station are controlled. The principal connections are shown. For instance, the control unit 26 is first connected to the central power supply of the spinning machine, i.e., the power grid, via the line 27. The control unit 26 may be connected to a central computer of the spinning machine (not shown) via a connection line 26*a*.

The control unit 26 controls the operational sequence of the various functional components and devices at the spinning station 2 in accordance with control data from the central computer and input data specific to the spinning station. For instance, feeding of the sliver 4 from the sliver can 3 is monitored by means of a sensor 36 spaced in advance of the feed roller. A breakage or other interruption in the sliver is detected by the sensor 36 and reported to the control unit 26 over a signal line 36*a*. The drive 37 of the feed roller (not shown) can thereupon be stopped via the signal line 37*a*. Via a signal line 7*a*, the rotation of the rotor can be monitored and the yarn piecing process can optionally be controlled by the service carriage 20. A signal line 12*a* connects a mechanism (not shown) adapted for raising one of the draw-off rollers 12 to the control unit 26. The signal line 13*a* connects the yarn quality sensor, i.e., the cleaner 13, to the control unit 26, while the cutting device 14 is actuated via a signal line 14*a*. The tension sensor 15, if present, reports the incident fluctuations in yarn tension to the control unit 26 over a signal line 15*a*. A signal line 19*a* serves to monitor signals representing the winding drum speed as detected by a sensor (not shown). A signal line 18*a* controls the drive of the creel 18 (not shown) when the cheese 17 is raised and lowered.

In the exemplary embodiment of FIG. 1, the feed roller drive 37 is controlled by the control unit 26 of the spinning station 2. According to the present invention, the feed roller drive 37 is a stepping motor, which is suitable for being operated incrementally in both a normal increment mode, i.e., wherein the angular increments of motor rotation are relatively larger and within a normal range of angular Steps sufficient to drive the sliver feed roller at a normal operating speed, and a microincrement mode, i.e., wherein the angular increments of motor rotation are relatively smaller and occur in such rapid repetivity that the motor operates essentially continuously in the nature of a DC motor to drive the sliver feed roller at a slower piecing-up speed. For that purpose, however, the stepping motor 37 requires its own actuation. Actuating units exist that are suitable solely for triggering a stepper motor in the normal increment mode and such units are substantially more economical than actuating units that enable stepper motor actuation by both modes. In the present exemplary embodiment shown in FIG. 1, one actuating unit 44 is provided to actuate the stepping motor 37 in both the normal increment mode 45 and the microincrement mode 46 by means of an electrical separation within the actuating unit 44. In normal spinning operation for continuous sliver feeding, the stepping motor 37 is triggered by the trigger unit 44 in the normal increment mode 45 via the power transmission line 37*a*. The control unit 26 determines in which mode the stepping motor will be operated via a control line 44*a* connecting the control unit 26 and the actuating unit 44 based on spinning station data received by the control unit 26.

In a yarn piecing operation, the stepping motor 37 is triggered by the control unit 44 in the microincrement mode 46, via the power transmission line 37*a*, because in the normal increment mode the stepping motor cannot be triggered sensitively enough for sliver feeding adapted to the piecing operation. That is, if the need for piecing a yarn is ascertained by the control unit 26 of the spinning station 2, then the control unit 26, via the line 44*a*, triggers the actuating unit 44 to drive the motor 37 in the microincrement mode 46 for the piecing operation.

The arrangement of the actuating unit in accordance with the exemplary embodiment has been chosen for illustrative purposes. The actuating unit may also be integrated with the spinning station control unit 26 or with the motor 37.

As shown in FIG. 1, a service carriage 20 has positioned itself at the front of the spinning station. Such service carriages are known in the art, for instance as described in German patent document DE-OS 28 50 729 or DE-OS 34 27 356. Accordingly, the construction of the service carriage is not shown in greater detail. Besides the function of cheese changing and yarn piecing, the service carriage can also carry cleaning equipment, e.g., so that the cleaning can be performed inside the spinning box 6 and at the rotor 7. Because this equipment is also known in further detail, for instance from German patent document DE-OS 37 15 934 or DE-OS 26 29 161, this equipment also is not shown or described in further detail herein.

A superstructure 21 of the spinning machine extends above the spinning stations 2, with a rail 22 that extends along all the spinning stations of the spinning machine. A driven wheeled undercarriage 23 of the service carriage 20 is supported on the rail 22 and supplementary support is provided by means of one or more wheels 24 on a rail 25 that extends along the spinning stations 2 at the front of the spinning machine 1 and is secured to the spinning boxes 6.

The supply of electrical power to the service carriage 20 may be accomplished via trailing chains, or as shown in FIG. 1, via sliding contact 28. An internal control unit 30 within the service carriage 20 is supplied with energy via a supply line 29 and in turn, controls the various functions of the service carriage, such as yarn piecing and cleaning of the rotor and optionally of the spinning box. The control of other functional components and devices of the service carriage (not shown) is accomplished via the signal lines such as representatively indicated at 31–33.

Communications between the control unit 26 of the spinning station 2 and the control unit 30 of the service carriage 20 is made possible by a transceiver 34 on the service carriage 20 which enables a bidirectional exchange of data between the control unit 30 of the service carriage and the control unit 26 of the spinning station 2. The spinning station 2 is equipped with a transmission and reception antenna 34*b* which is connected to the spinning station control unit 26 via a signal line 34*a*. The transceiver 34 of the service carrier 20 has a compatible transmission and receiving antenna 34*c* which is similarly connected to the control unit 30 over a signal line 34*d*. A control line 35 connects the control unit 30 to the drive of the undercarriage 23 (not shown).

Figure 2:
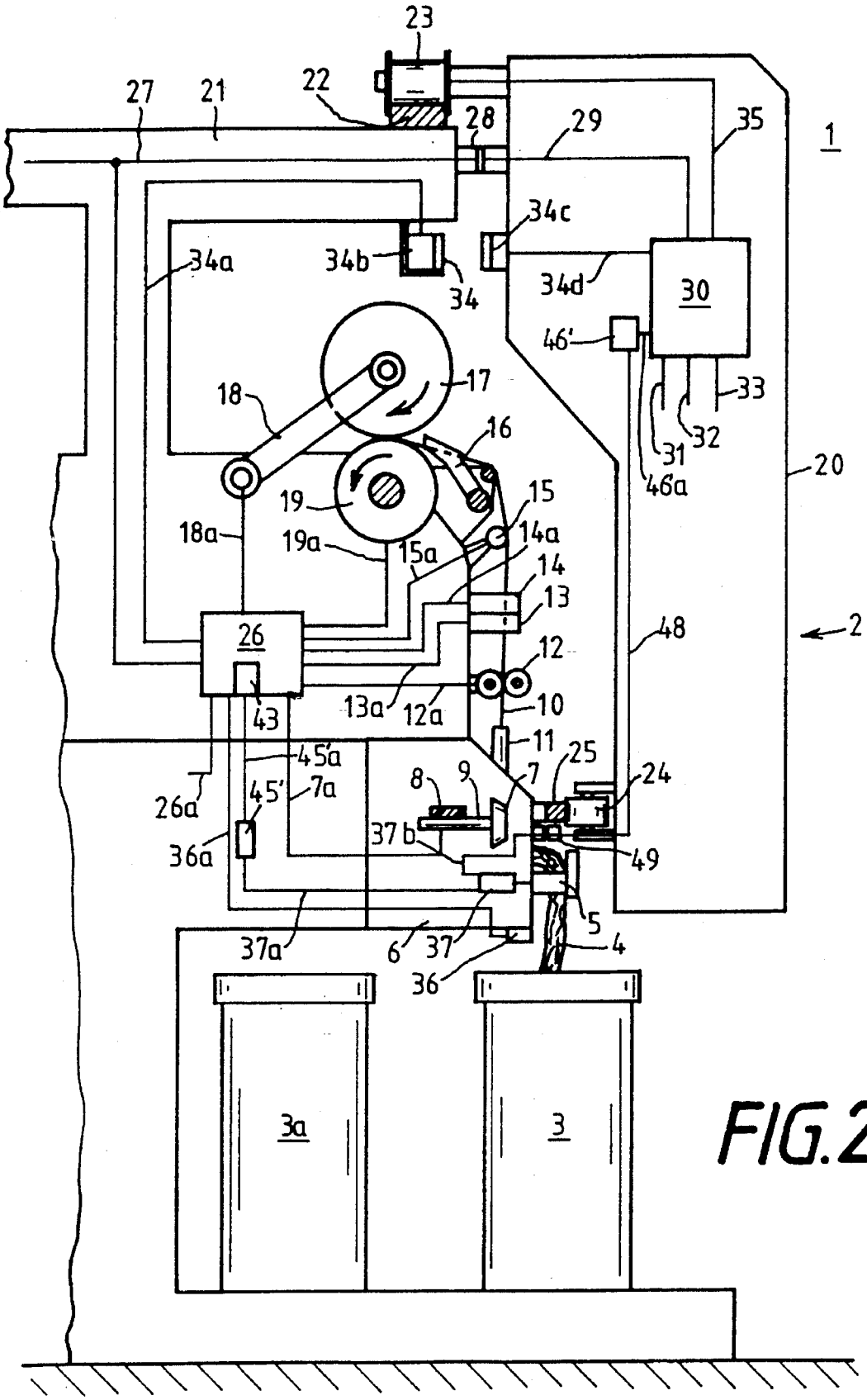
FIG. 2 is a schematic end view of one spinning station of a rotor spinning machine having a stepping motor driving the sliver feed roller, with a service carriage in position at the front of the spinning station carrying an actuating unit for the microincrement mode.

In the alternative embodiment of FIG. 2, a separate actuating unit for the microincrement mode, which is advantageously used especially for yarn piecing operations, is disposed on the service carriage 20 as indicated at 46, which is a advantageous for reasons of cost, because the yarn piecing operation is accomplished from the service carriage. As a result, only one such actuating unit is needed for all of the spinning stations of the entire spinning machine which are served by the service carriage. An individual actuating unit 45' for the normal increment mode remains at each spinning station 2. If there is no service carriage with a yarn piecing device, then it will be necessary to equip each spinning station as shown in the embodiment of FIG. 1.

If the service carriage 20 has moved into position at the front of the spinning station 2 and a yarn piecing operation is needed, then an operative connection must be established to transmit power between the actuating unit 46' for the microincrement mode and the stepping motor 37 of the feed roller. Since the piecing operation is controlled by the control unit 30 of the service carriage 20, the actuating unit 46' communicates over the signal line 46' a with the control unit 30.

In this embodiment, an electrical coupling is provided between the actuating unit 46' and the stepping motor 37. Via the power transmission line 48, electrical current is carried to a mechanical contact connection 49 established between the service carriage 20 and the winding station 2 and is fed therefrom into a line 37*b* to the stepping motor 37. After yarn piecing has been accomplished, the control unit 30 transmits a signal to the control unit 26 of the spinning station 2 to energize the actuating unit 45' for the normal increment mode via the signal line 45'*a*. The connection 49 between the motor 37 of the feed roller and the actuating unit 46' for the microincrement mode is disconnected when the service carriage 20 is called to a different spinning station.

Figure 3:
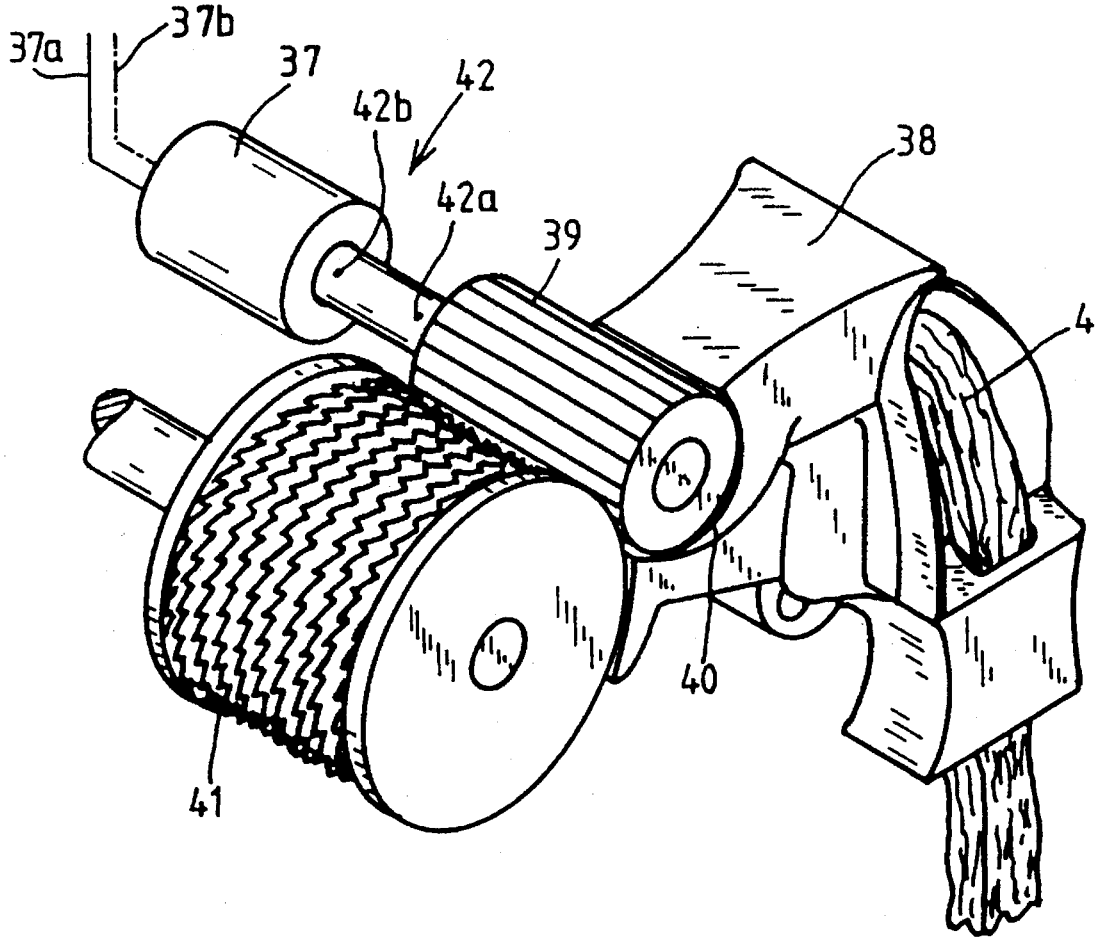
FIG. 3 is a perspective view of the feed roller and opening roller for the spinning station of either FIGS. 1 or 2.

FIG. 3 is a perspective view of the sliver opening components in the spinning box 6. The sliver condenser 38 directs the sliver 4 to the forward side of the feed roller 39. The sliver is drawn in by the fluted feed roller over the feed table 40 and is presented to the opening roller 41. In a known manner, the opening roller is toothed to open the sliver and separate its individual fibers, so that they can be delivered to the rotor (not shown). Further details of this opening arrangement are known from the prior art and need not be described.

As can be seen from FIG. 3, the feed roller 39 is connected directly by its drive shaft 42*a* to the drive shaft 42*b* of the drive motor 37, which as above described is a stepping motor. The stepping motor 37 is connected via signal lines 37*a*, 37*b* to the corresponding actuating unit 44 in FIG. 1 or actuating units 45', 46', respectively, in FIG. 2 These actuating units can in turn be energized by the control unit 26 of the spinning station 2 in the embodiment of FIG. 1 or by the control unit 30 of the service carriage 20 in the embodiment of FIG. 2. Driving the feed roller 39 directly via a rigid connection 42 with the stepping motor 37 has the significant advantage of not requiring any actuable mechanical coupling between the motor and the opening roller. For instance, if the sensor 36 ascertains the absence of sliver 4, then the drive motor 37 can be stopped directly via the control line 37*a* without the necessity in the prior art of disconnecting an electromagnetic coupling or the like that connects the feed roller to a common drive extending along the entire machine.

Advantageously, the feed roller can be actuated from any arbitrary position and, on the basis of the increments that can be accomplished by the digitally actuated stepping motor, the feed roller can deliver a precisely defined quantity of fibers into the rotor, which would not be possible with a mechanical coupling and gearing between the drive motor and the feed roller, because production tolerances and the play of the coupling make precisely accurate feeding difficult. This inaccuracy prevails whenever feeding of the fibers is carried out in the known manner of the prior art from the piecing carriage.

The rigid connection 42 between the stepping motor 37 and the feed roller 39 also offers non-delayed control, unaffected by any coupling play, of sliver feeding to eliminate sliver defects, and especially long-term defects that lead to moiré effects. On the other hand, a predetermined variable actuation of the stepping motor 37 via a random generator 43 (FIGS. 1 and 2) that is associated with the control unit 26 and also affects the normal increment mode of the actuating unit 44 or 45' makes it possible to spin a special-effect yarn. With the random generator 43, random changes in the speed of sliver feeding can be produced and controlled. To carry out a regulated sliver feeding during yarn piecing, as well as when sliver defects are being eliminated and in producing special-effect yarns, sensors are required to monitor the sliver feeding, yarn tension, and yarn quality, e.g., the sensor 36 for monitoring sliver feeding, the sensor 13 for quality monitoring, and the sensor 15 for checking yarn tension, as already described in conjunction with FIG. 1 above. These sensors each communicate with the control unit 26 of the spinning station 2 via the respective signal lines 38*a*, 13*a*, and 15*a*. Once the service carriage 20 has positioned itself at the front of the spinning station, the transceiver 34 enables bidirectional exchange of the sensed data with the control unit 30 of the service carriage.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A rotor spinning machine having a spinning station comprising a spinning rotor, an opening roller, a feed roller for delivery sliver to the opening roller, a stepping motor connected directly to the feed roller for driving rotation thereof, and means for actuating the stepping motor selectively to drive the feed roller including a means for a normal driving mode advancing in normal stepped increments of the stepping motor during normal spinning operation and a means for a second driving mode advancing in shorter stepped microincrements of the stepping motor during yarn piecing operations.

2. The rotor spinning of claim 1, further comprising a control unit for controlling actuation of the stepping motor actuating means to select the means for a normal driving mode and the means for a second driving mode.

3. The rotor spinning machine of claim 1, further comprising a mobile service carriage for traveling movement along the spinning machine, the actuating means comprising a first actuating unit at the spinning station for actuating the stepping motor by the means for a normal driving mode and a first control unit for controlling actuation of the first actuating unit, and a second actuating unit on the service carriage for actuating the stepping motor by the means for a second driving mode and a second control unit on the service carriage for controlling actuation of the second actuating unit, and coupling means at the spinning station and on the service carriage for establishing an operative connection between the second actuating unit and the stepping motor when the service carriage is positioned at the spinning station.

4. The rotor spinning machine of claim 1, further comprising a control unit for controlling actuation of the actuating means, the control unit having a random generator selectively operative with the means for a normal driving mode of the stepping motor for variably actuating the stepping motor to control random speed changes in sliver delivery to produce special-effects in the yarn.

5. The rotor spinning machine of claim 1, further comprising a control unit for controlling actuation of the actuating means and a sensor spaced in advance of the feed roller in the direction of the sliver travel for monitoring the sliver, the sensor being operatively connected to the control unit.

6. The rotor spinning machine of claim 1, further comprising a control unit for controlling actuation of the actuating means and a sensor for monitoring the quality of the yarn, the sensor being operatively connected to the control unit.

* * * * *